US007533704B2

(12) United States Patent
Chuang

(10) Patent No.: US 7,533,704 B2
(45) Date of Patent: May 19, 2009

(54) TOOL-SHAFT LOCKING DEVICE FOR A PLANING MACHINE

(76) Inventor: Bor-Yann Chuang, No. 78, Yungfeng Rd., Taiping City, Taichung (TW) 411

( * ) Notice: Subject to any disclaimer, the term of this patent is extended or adjusted under 35 U.S.C. 154(b) by 309 days.

(21) Appl. No.: 11/518,406

(22) Filed: Sep. 11, 2006

(65) Prior Publication Data

US 2008/0060721 A1 Mar. 13, 2008

(51) Int. Cl.
*B27C 1/00* (2006.01)

(52) U.S. Cl. ..... 144/114.1; 144/117.1; 144/218

(58) Field of Classification Search ..... 144/114.1, 144/117.1, 131, 132, 172, 218, 221, 230, 144/116, 129, 130, 253.1, 253.8; 83/698.41, 83/698.51

See application file for complete search history.

(56) References Cited

U.S. PATENT DOCUMENTS 4,842,029 A * 6/1989 De Abreu ..... 144/117.1

6,382,278 B1 * 5/2002 Liao et al. ..... 144/252.1

* cited by examiner

*Primary Examiner*—Shelley Self
(74) *Attorney, Agent, or Firm*—Ming Chow Sinorica, LLC

(57) ABSTRACT

A tool-shaft locking device for a planing machine is connected with a second end of the tool shaft having a first end connected with a belt wheel, including a bearing base, a locking rod, a spring and a locking button. The bearing base has a sidewise hole, two opposite deep position grooves at an upper and a lower side of the hole and two opposite shallow grooves at a right and a left side, and the locking rod has a first threaded end tightly engaging a center threaded hole of the locking button, which has two opposite position projections possible to be fitted tightly in the deep grooves so that the inner end of the locking rod may insert in one of position holes of the tool shaft body so as to lock the tool shaft immovable. Then a planing knife fixed on the tool shaft with bolts can be adjusted in its position, conveniently by easily screwing off the bolts.

3 Claims, 5 Drawing Sheets

TOOL-SHAFT LOCKING DEVICE FOR A PLANING MACHINE

BACKGROUND OF THE INVENTION

1. Field of the Invention

This invention relates to a planing machine, particularly to one provided with a tool-shaft locking device.

2. Description of the Prior Art

A conventional planing machine generally has a tool shaft on the machine base, and the tool shaft is provided with a planing knife, which is rotated together with the tool-shaft for planing a work. FIG. 1 shows a conventional planing machine, which includes a tool-shaft 10, a belt wheel 21 fixed on one end of the tool-shaft 10, an endless belt 20 extending around the belt wheel 21 and also around an belt wheel fixed on a spindle of a motor 21. Further, a plate cover 11 is fixed on a shaft body 13, with a planing knife 14 sandwiched between the plate cover 11 and the shaft body 13 by means of bolts. In case the planing knife 14 is needed to be adjusted vertically in its position on the shaft body 13, the bolts 12 have to be loosened first before the planing knife 14 can be moved up or down relative to the shaft body 13. Then the bolts 12 are to be screwed tightly again to lock the planing knife 14 at the adjusted position.

However, the shaft body 13 can rotate in adjusting process of the planing knife 14, so the belt wheel 21 has to be held tightly with one hand, and the planing knife 14 is to be held with the other hand for adjusting. Therefore, there is a potential danger of hurting the other hand in adjusting the sharp planing knife 14, causing inconvenience in using the conventional planing machine.

SUMMARY OF THE INVENTION

This invention has been devised to offer a tool-shaft locking device for a planing machine.

The feature of the invention is a bearing base, a locking rod and a locking button together composing the locking device. The bearing base is combined with a bearing fixed on a first end of a tool shaft of the planing machine, provided with a hole near a circumferential edge and two opposite deep position grooves formed at an upper and a lower side of the hole and two opposite shallow position grooves at a right and a left side of the hole. The locking rod has a first threaded end threadably engaged with a center threaded hole of an inner end of the locking button, which has two opposite projections formed at an inner end. Further, a spring is fitted around the first threaded end of the locking rod to enable the locking button elastically pulled outward for a certain distance. Then the locking button can be combined tightly with the locking rod by engagement of the threaded hole of the locking button and the threaded end of the locking rod. So when the locking button is in an unlocking position, the two projections of the locking button fits in the two opposite shallow grooves of the bearing base, with the inner end of the locking rod separated from one of the plural position holes of the tool shaft body, so that the tool shaft may be rotated freely to carry out planing work. If the planing knife is wanted to be adjusted in its position on the tool shaft body, and the tool shaft is needed to be locked immovable, the locking button in the unlocking position is pulled elastically outward for the preset distance to let the two projections of the locking button separate from the two opposite shallow grooves of the bearing base to enable the locking button rotate. Then the locking button is rotated for 90 degrees and then released elastically to let the two projections to fit in the two opposite deep position grooves of the bearing base, with the inner end of the locking rod moved inward to fit in one of the position holes of the tool shaft body. Then the tool shaft is locked immovable and impossible to rotate by the locking device.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
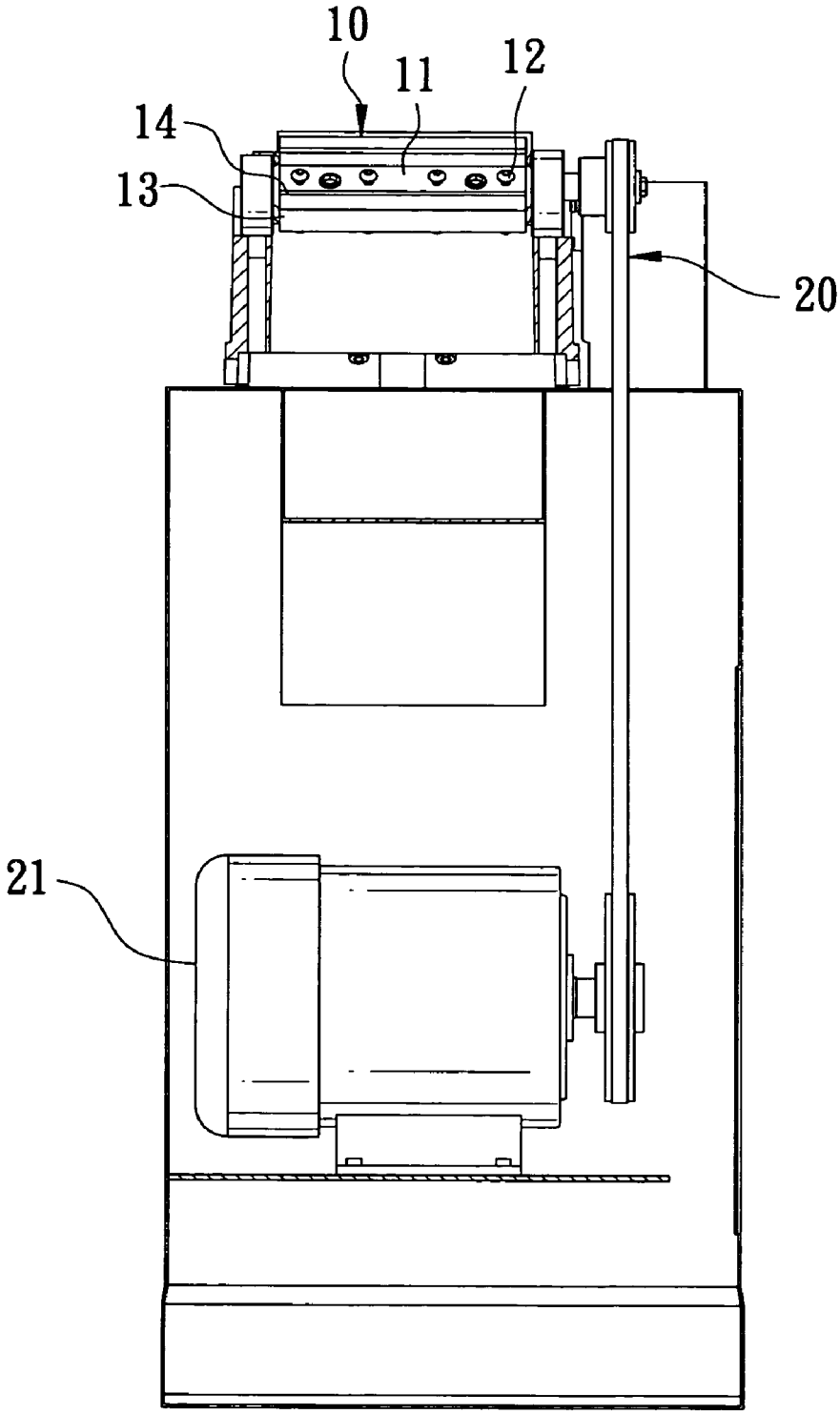
FIG. 1 PRIOR ART
FIG. 1 is a side view of a conventional planing machine.
Figure 2:
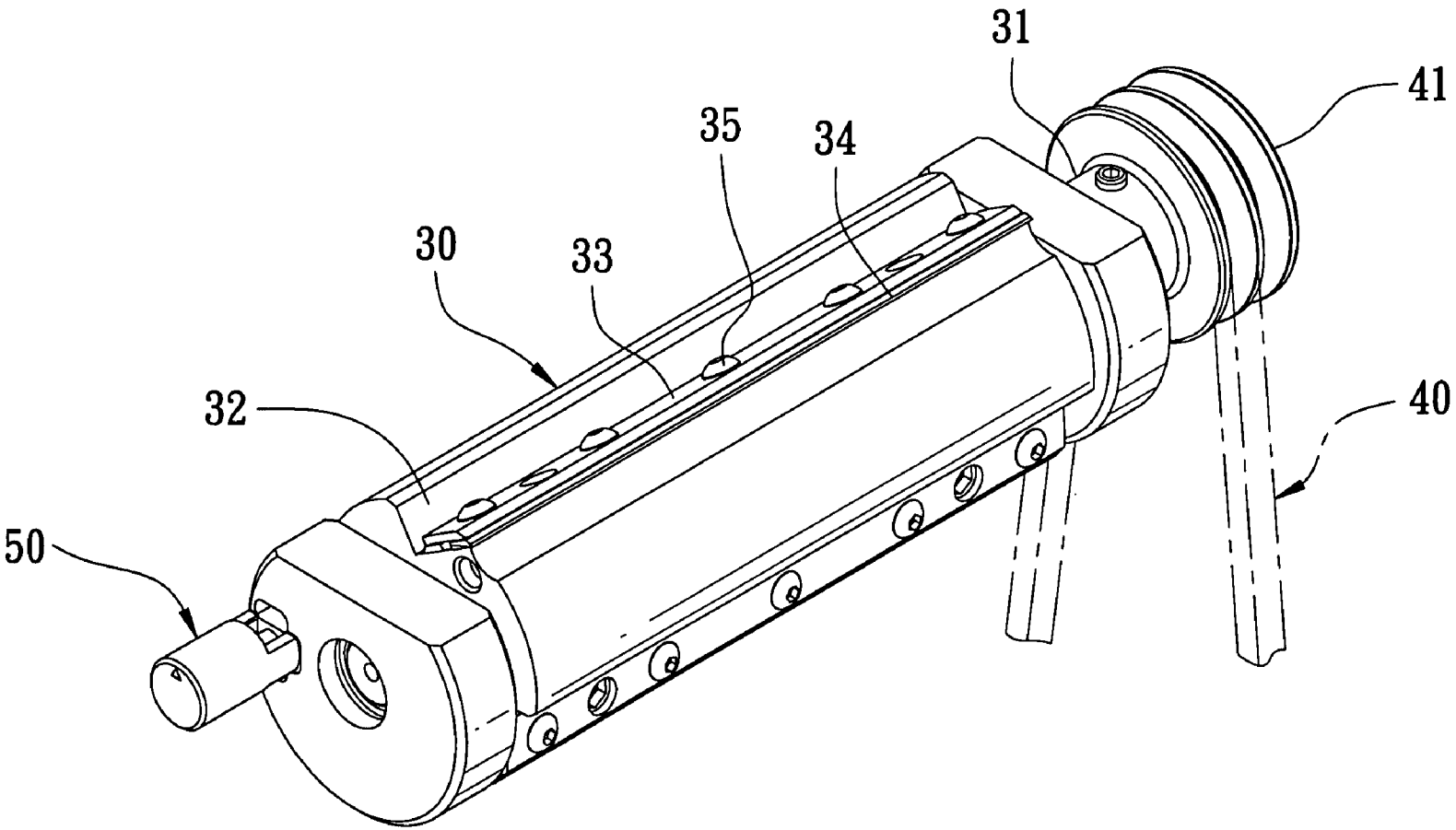
FIG. 2 is a perspective view of a preferred embodiment of a tool-shaft locking device for a planing machine in the present invention.
Figure 3:
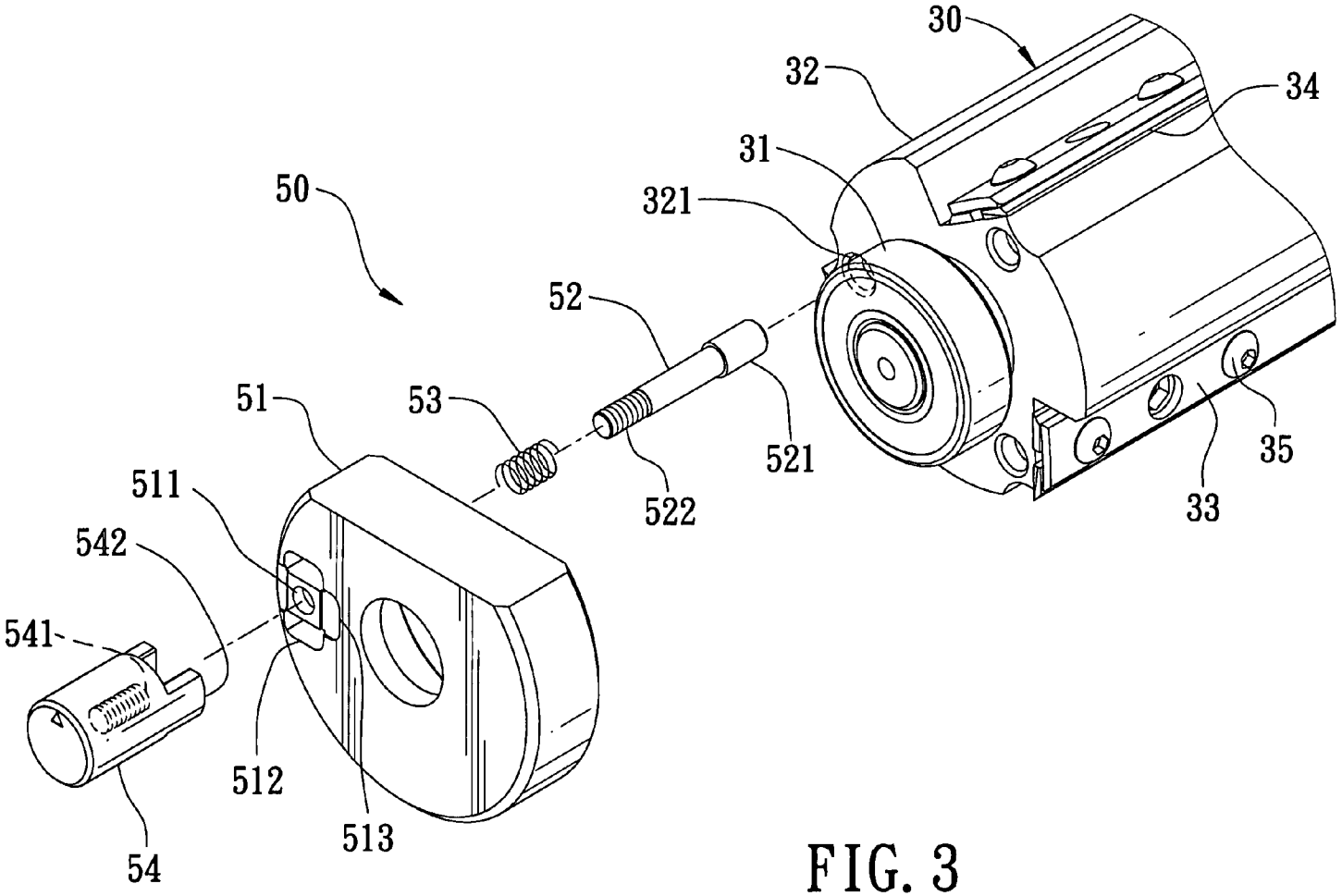
FIG. 3 is a partial exploded perspective view of the preferred embodiment of the tool-shaft locking device for a planing machine in the present invention.

A preferred embodiment of a tool-shaft locking device 50 for a planing machine in the present invention, as shown in FIGS. 2 and 3, is combined with a tool shaft 30 of the machine base of a planing machine, and the tool shaft 30 consists of two shaft bearings 31, a tool shaft body 32, a plate cover 33, a planing knife 34 and plural bolts 35. The planing knife 34 is sandwiched between the plate cover 33 and the shaft body by means of the bolts 35, with its position adjustable by removing the bolts. Then one of the bearing 31 connected to a second end of the tool shaft 30 has its outer side fixed with a belt wheel 41, and an endless belt 40 extending around the belt wheel 40 and also around another belt wheel fixed on the spindle of a motor so that the tool shaft 31 may be rotated by the motor via the belt 40 and the belt wheel 41.

The tool-shaft locking device 50 is combined with the other side of one of the bearings 31 connected to a first end of the tool shaft 30, including a bearing base 51, a locking rod 52, a spring 53 and a locking button 54. The tool shaft body 32 is provided with plural position holes 321 space apart near around the circumference to correspond to a first (inner) end of the locking rod 52.

The bearing base 51 is combined with the bearing 31 on the first end of the tool shaft 30, having a hole 511 near a left edge aligning to any of the position holes 321 of the shaft body 32, two opposite deep position grooves 512 respectively at an upper and an lower side of the hole 511 and two opposite shallow position grooves 513 respectively at a right and a left side of the hole 511.

The locking rod 52 has a position (inner) end 521 to fit in any of the position holes 321 of the shaft body 32, and a threaded (outer) end 522, and the spring 53 fits around the threaded end 522. The locking rod 52 extends through the hole 511 and to be threadably combined tightly with the locking button 54.

The spring 53 is a coiled spring around the threaded end 522 of the locking rod 52.

The locking button 54 has a center threaded hole 541 formed in an inner end for the threaded end 522 of the locking rod 52 to engage with, and two opposite position projections 541 extending out from the annular edge of the inner end. After the locking button 54 is combined with the locking rod 52 with the spring fitted around the threaded end of the locking rod 52, the locking button 54 may be pulled out elastically for a certain distance so that the locking rod can be moved outward to let its inner (position) end separate from any of the position holes 321 of the tool shaft 32.

Figure 4:
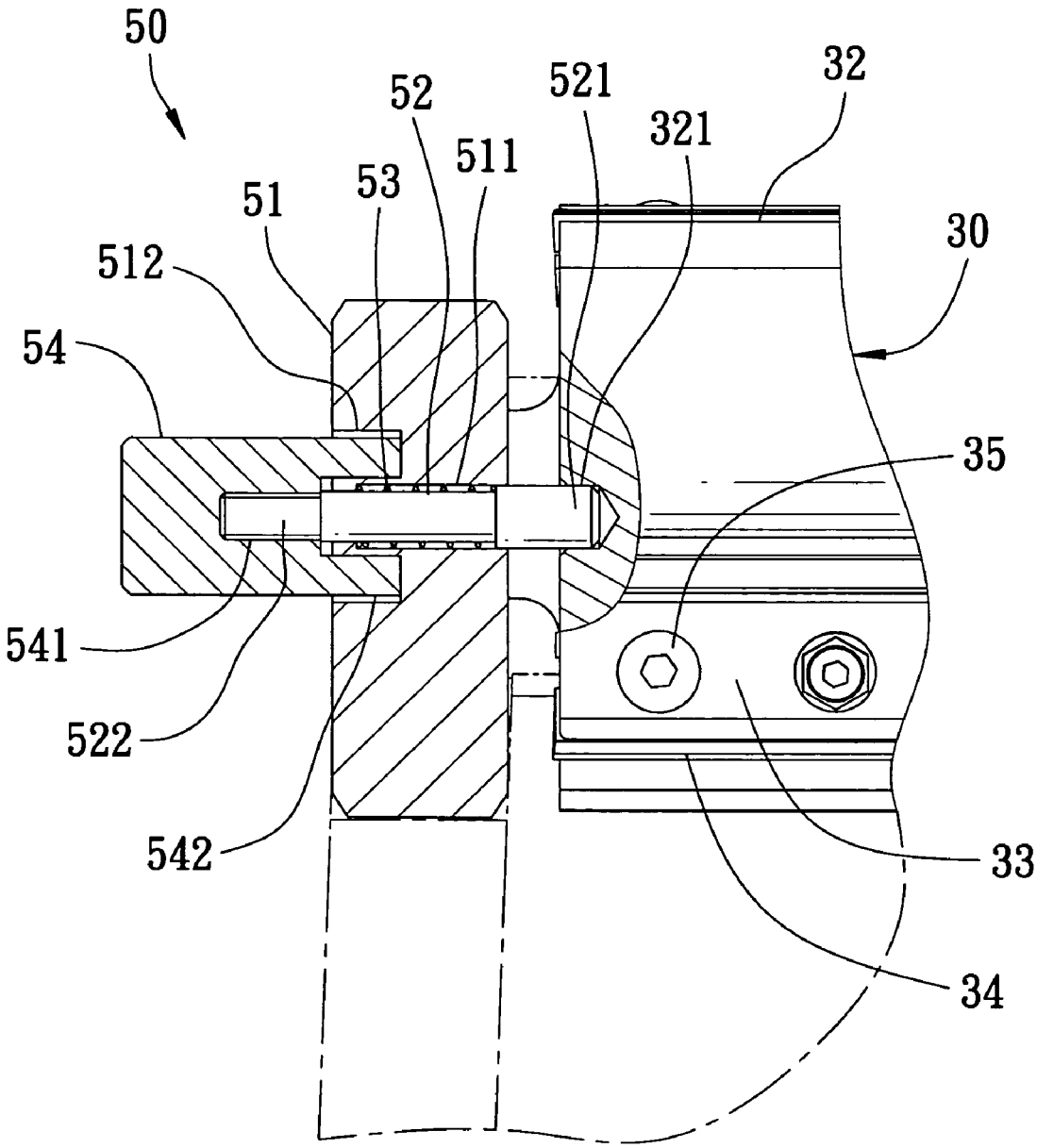
FIG. 4 is a cross-sectional view of the tool-shaft locked by the locking device in the present invention; and, FIG. 5 is a cross-sectional view of the tool-shaft unlocked by the locking device in the present invention.

In assembling, as shown in FIGS. 2, 3 and 4, firstly, the threaded end 522 of the locking rod 52 with the spring 53 fitted around is made to extend outward through the hole 511 of the bearing base 51 and then the locking button 54 is rotated to let the threaded hole 541 engage tightly with the threaded end 522 of the locking rod 52. Then the locking button 54 combined together with the locking rod 52 can be pulled outward and released to move inward for a certain distance by elasticity of the spring 53. In addition, the two opposite position projections 542 of the locking button 54 can be alternately placed to fit in the two deep position grooves 512 or the two shallow position grooves 513 so as to change the position of the locking rod 52 to let the tool shaft 30 locked immovable or released to rotate freely for carrying out planing work.

In using, as shown in FIGS. 2, 3 and 4, if the planing knife 34 is wanted to be adjusted in its position, it is necessary to pull outward a little the locking button 54 together with the locking rod 52 in the unlocked condition wherein the two projections 542 of the locking button 54 fits in the two shallow grooves 513 of the bearing base 51 with the inner end of the locking rod separated from any of the position holes 321 of the tool shaft body 32 with the tool shaft 30 possible to rotate for carrying out planing work, and then is rotated for 90 degrees and released elastically to let the two projections fit in the two deep projections 512 of the bearing base 51 so as to let the inner (position) end 521 of the locking rod 52 moved to fit in one of the position holes 321 of the tool shaft body 32 to lock the tool shaft 30 from rotating. Then the planing knife 34 can be freed to be adjusted in its position by removing the bolts 35, as shown in FIG. 4. Therefore, an user can proceed adjusting the position of the planing knife 34 safely, without any potential risk of hurting the hand.

Figure 5:
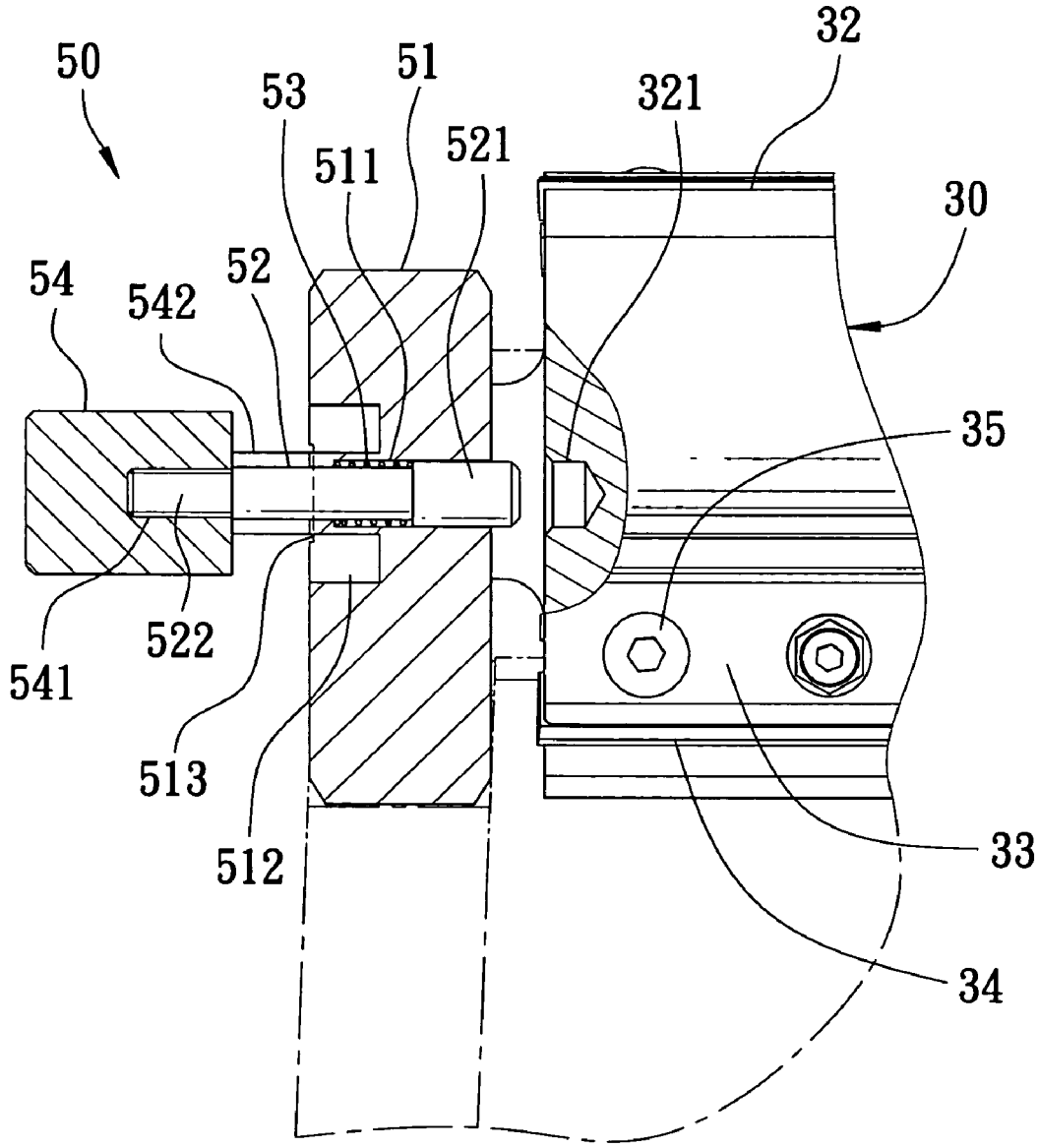

Moreover, as shown in FIGS. 2, 3 and 5, after the planing knife 34 is finished in adjusting its position or in replacement, it is only necessary to pull outward the locking button 54 a little, with its two position projections 542 separated from the two deep grooves 512 and then rotate the locking button 54 for about 90 degrees and then released to let the two position projections 542 to fit elastically in the two shallow grooves 513 of the bearing base 51 so that the inner end 521 of the locking rod may be kept separated from any of the position holes 321 of the shaft body 32. Then the tool shaft 30 becomes free to rotate. In this way, the locking device 50 has two different positions easily handled, one for locking the tool shaft 30 and the other for unlocking the tool shaft 30 to freely rotate.

As can be seen from the above description, the invention has the advantage that the locking device is adjustable in its position to either lock the tool shaft or unlock the tool shaft to rotate so that the locking button has its position projections fitting in the deep grooves for locking the tool shaft immovable so as to remove the bolts with both hands for adjusting the position of the planing knife. Thus, the planing knife can be adjusted in its position safely, without any potential danger of hurting the hands of a user.

While the preferred embodiment of the invention has been described above, it will be recognized and understood that various modifications may be made therein and the appended claims are intended to cover all such modifications that may fall within the spirit and scope of the invention.

What is claimed is:

1. A tool-shaft locking device for a planing machine, said tool shaft comprises of two shaft bearings, a shaft body, a plate cover, a planing knife and plural bolts, a first one of said shaft bearings tightly connected with a right end of said shaft body and then connected to a belt wheel, said belt wheel being driven to rotate by an endless belt extended around said belt wheel and also around another belt wheel fixed on a spindle of a motor:

a locking device connected with a second one of said shaft bearings connected with a right end of said shaft body, said locking device consisting of a bearing base, a locking rod, a spring and a locking button;

said bearing base connected with said second shaft bearing, said bearing base provided with a hole to align to a position hole bored in said right end of said shaft body, two opposite deep position grooves formed at an upper and a lower side of said hole of said bearing base;

said locking rod having a first threaded end tightly engaging with said locking button and a second end fitting through said hole of said bearing base;

said locking button provided with a center threaded hole in an inner end thereof for said first threaded end of said locking rod to engage tightly, said locking button having two opposite position projections extending forward from the inner end; and, said two opposite position projections of said locking button possible to fit in said deep grooves of said bearing base, said locking button then rotated inward to force said locking rod moved threadably and gradually into said position hole of said shaft body for locking said tool shaft immovable.

2. The tool-shaft locking device for a planing machine as claimed in claim 1, wherein said bearing base is provided with two opposite shallow position grooves at a right and a left side of said hole thereof.

3. The tool-shaft locking device for a planing machine as claimed in claim 1, wherein said locking rod is fitted around by a spring and extending through said hole of said bearing base for.

* * * * *